US008842102B2

(12) United States Patent
Forster et al.

(10) Patent No.: US 8,842,102 B2
(45) Date of Patent: Sep. 23, 2014

(54) GRAPHIC MEDIC DISPLAY DEVICE AND METHOD FOR USING SAME

(75) Inventors: Ian J. Forster, Essex (GB); David Welch, Somerset (GB); Mark Bartlett, Surrey (GB)

(73) Assignee: Avery Dennison Corporation, Glendale, CA (US)

( * ) Notice: Subject to any disclaimer, the term of this patent is extended or adjusted under 35 U.S.C. 154(b) by 408 days.

(21) Appl. No.: 13/014,904

(22) Filed: Jan. 27, 2011

(65) Prior Publication Data

US 2012/0127211 A1 May 24, 2012

Related U.S. Application Data

(60) Provisional application No. 61/416,384, filed on Nov. 23, 2010, provisional application No. 61/423,139, filed on Dec. 15, 2010.

(51) Int. Cl.

| | |
|---|---|
| ***G09G 5/00*** | (2006.01) |
| ***G09F 7/04*** | (2006.01) |
| ***G09F 15/02*** | (2006.01) |
| ***G09F 15/00*** | (2006.01) |
| *G09F 13/22* | (2006.01) |
| *G09F 27/00* | (2006.01) |

(52) U.S. Cl.

CPC ..... *G09F 7/04* (2013.01); *G09F 2013/222* (2013.01); *G09F 15/02* (2013.01); *G09F 15/0018* (2013.01); *G09F 13/22* (2013.01); *G09F 2027/001* (2013.01); *G09F 15/0012* (2013.01); *G09F 27/00* (2013.01)

USPC ..... 345/204; 345/158

(58) Field of Classification Search

USPC ..... 345/158, 204, 690; 349/61, 62; 455/556.1, 556.2, 566; 362/97.1

See application file for complete search history.

(56) References Cited

U.S. PATENT DOCUMENTS

| | | | | |
|---|---|---|---|---|
| 7,374,258 | B2 * | 5/2008 | Bowron | 312/7.2 |
| 8,330,739 | B2 * | 12/2012 | Miller et al. | 345/173 |
| 2003/0106247 | A1 | 6/2003 | Huang | |
| 2003/0221349 | A1 * | 12/2003 | Abe | 40/711 |
| 2007/0029939 | A1 | 2/2007 | Burkum | |
| 2008/0084360 | A1 * | 4/2008 | Shingai | 345/1.3 |
| 2009/0104941 | A1 * | 4/2009 | Kwon et al. | 455/566 |

FOREIGN PATENT DOCUMENTS

| | | |
|---|---|---|
| JP | 2006-011422 | 1/2006 |
| JP | 2006-030882 | 2/2006 |
| JP | 2006-058435 | 3/2006 |
| JP | 2008-276124 | 11/2008 |
| KR | 2010-0114195 | 10/2010 |

OTHER PUBLICATIONS

International Search Report and Written Opinion issued in corresponding IA No. PCT/US2011/022693 dated Jun. 29, 2011.

* cited by examiner

*Primary Examiner* — Abbas Abdulselam

(74) *Attorney, Agent, or Firm* — Avery Dennison Corporation

(57) ABSTRACT

According to one exemplary embodiment, an apparatus and method for displaying graphic media are disclosed. The apparatus and method can contain and secure graphic media and provide illumination. The apparatus and method may also contain electronic communication devices.

20 Claims, 6 Drawing Sheets

GRAPHIC MEDIC DISPLAY DEVICE AND METHOD FOR USING SAME

CROSS-REFERENCE TO RELATED APPLICATIONS

The present application claims the benefit of U.S. Provisional Patent Application Nos. 61/416,384 filed Nov. 23, 2010, and 61/423,139 filed Dec. 15, 2010, both of which are incorporated herein by reference in their entireties.

FIELD OF THE INVENTION

The present invention is in the field of advertising and marketing displays, and more particularly to interactive displays using near field communications and radio frequency identification (RFID) devices.

BACKGROUND OF THE INVENTION

Standard visual displays take on a variety of forms. Static displays showing a drawn or photographed image have long been used to convey a message or promote an idea. Additionally, in the field of advertisements, traditional posters with an image and some text are often used. These are frequently used outdoors and in areas of high traffic, so as to get the subject matter of the poster greater exposure. More recently, alterable displays have allowed for the use of lighting in conjunction with the static display to enhance or otherwise alter the display.

Yet other advertisements may be made using flat panel display technologies. These displays are readily changeable and editable and can be made to display any of a variety of images or text. These displays are, however, often very expensive, thus making them impractical for many uses. For example, it would not be desirable to place or mount a flat panel display in an area where it could be easily damaged or removed by an unauthorized person.

Still other displays use light guides to illuminate all or part of the display. A light guide can be a hollow box-shaped structure defining an optical cavity or a solid light-guiding plate. The guide can have a surface that is illuminated by light directed into the guide in a direction generally parallel to that surface. The light may be supplied from one or more light sources arranged on an edge of the light guide. Traditional light guides, however, are often expensive and may not allow for the positioning of the display to be altered or have proper or desired distribution of the light throughout the light guide. Moreover they do not allow for the variation of an image or the display of images on different layers.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

According to one exemplary embodiment, an apparatus and method for displaying graphic media are disclosed. The apparatus and method can contain and secure graphic media and provide illumination. The apparatus and method may also contain electronic communication devices.

In accordance with a further exemplary embodiment of the presently described invention, a graphic media display device is described and includes a display device, the display device having a front panel and a template panel, with the front panel having a transparent portion through which a graphic may be view. The template panel has a viewing aperture with one or more magnetic fasteners, and the viewing aperture is sized and configured to correspond with the transparent portion of the front panel.

Continuing with a discussion of the presently described embodiment, a rear panel is provided that has one or more magnetic fasteners, with the magnetic fasteners of the template panel and rear panel being in alignment with one another. The rear panel further including an illumination device. A graphic media layer that has a graphic image surface and a back surface, with the graphic image being sized and configured to be viewed through the template panel viewing aperture. A RFID device associated with the graphic media layer.

In yet a further exemplary embodiment of the presently described invention a method of using a graphic media display devices, is described and includes the steps of initially providing a graphic media display device, the graphic media display device having a front panel, template panel and a rear panel, the rear panel having an illumination device. Then, producing a graphic media layer having a visible graphic on at least one side, with the graphic media layer further including a electronic communication device. The graphic media layer is inserted between the template layer and the front panel such that the graphic media layer is adhered to the front panel such that the visible graphic is viewable through an aperture in the front panel. Finally, the illumination device is activated to illuminate the graphic media layer.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION OF THE INVENTION

Aspects of the present invention are disclosed in the following description and related figures directed to specific embodiments of the invention. Those skilled in the art will recognize that alternate embodiments may be devised without departing from the spirit or the scope of the claims.

Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Further, many of the embodiments described herein are described in terms of sequences of actions to be performed by, for example, elements of a computing device. It should be recognized by those skilled in the art that the various sequence of actions described herein can be performed by specific circuits (e.g., application specific integrated circuits (ASICs)) and/or by program instructions executed by at least one processor. Additionally, the sequence of actions described herein can be embodied entirely within any form of computer-readable storage medium such that execution of the sequence of actions enables the processor to perform the functionality described herein. Thus, the various aspects of the present invention may be embodied in a number of different forms, all of which have been contemplated to be within the scope of the claimed subject matter. In addition, for each of the embodiments described herein, the corresponding form of any such embodiments may be described herein as, for example, "a computer configured to" perform the described action.

Figure 1:
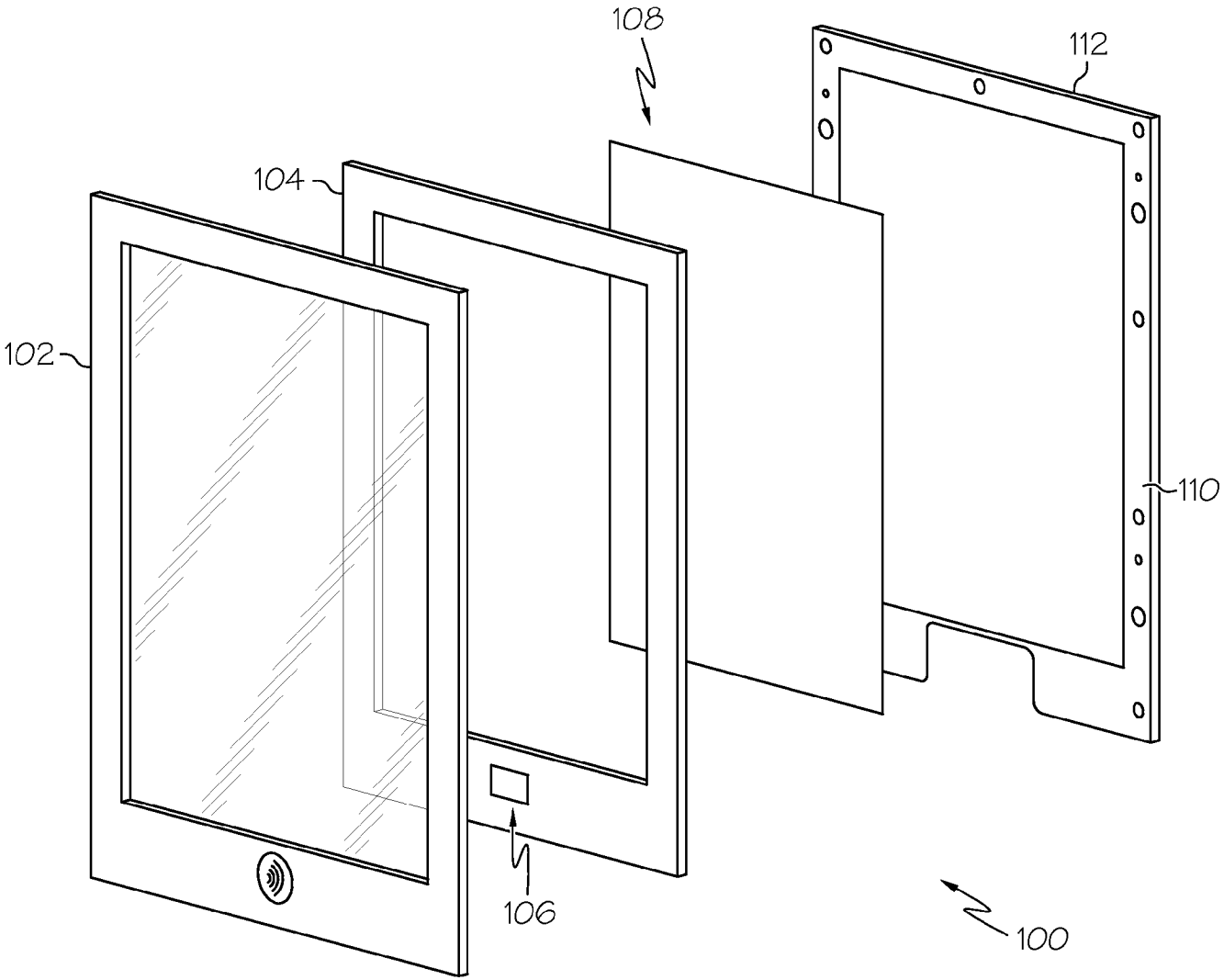
FIG. 1 is an exploded view of an exemplary embodiment of a display device.
Figure 2:
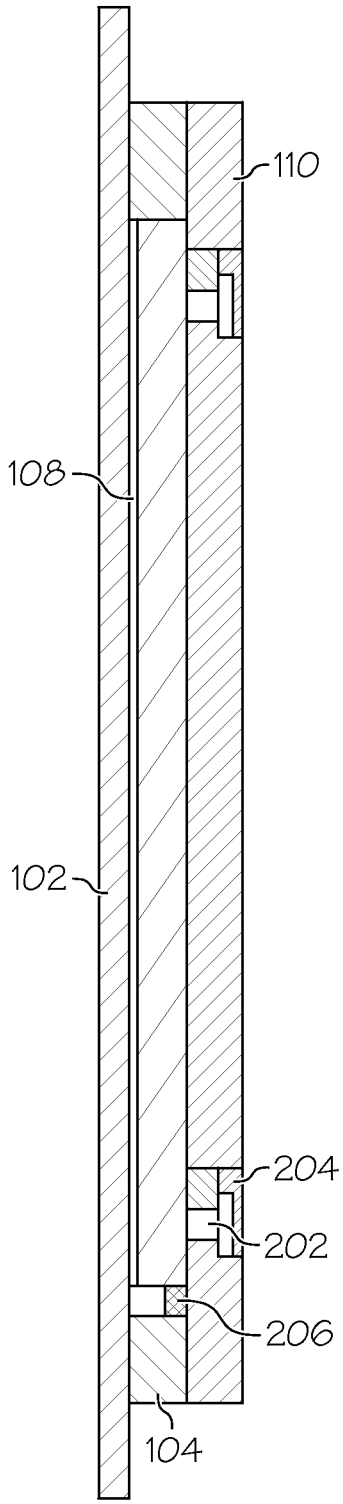
FIG. 2 is a side view of an exemplary embodiment of a display device.
Figure 3:
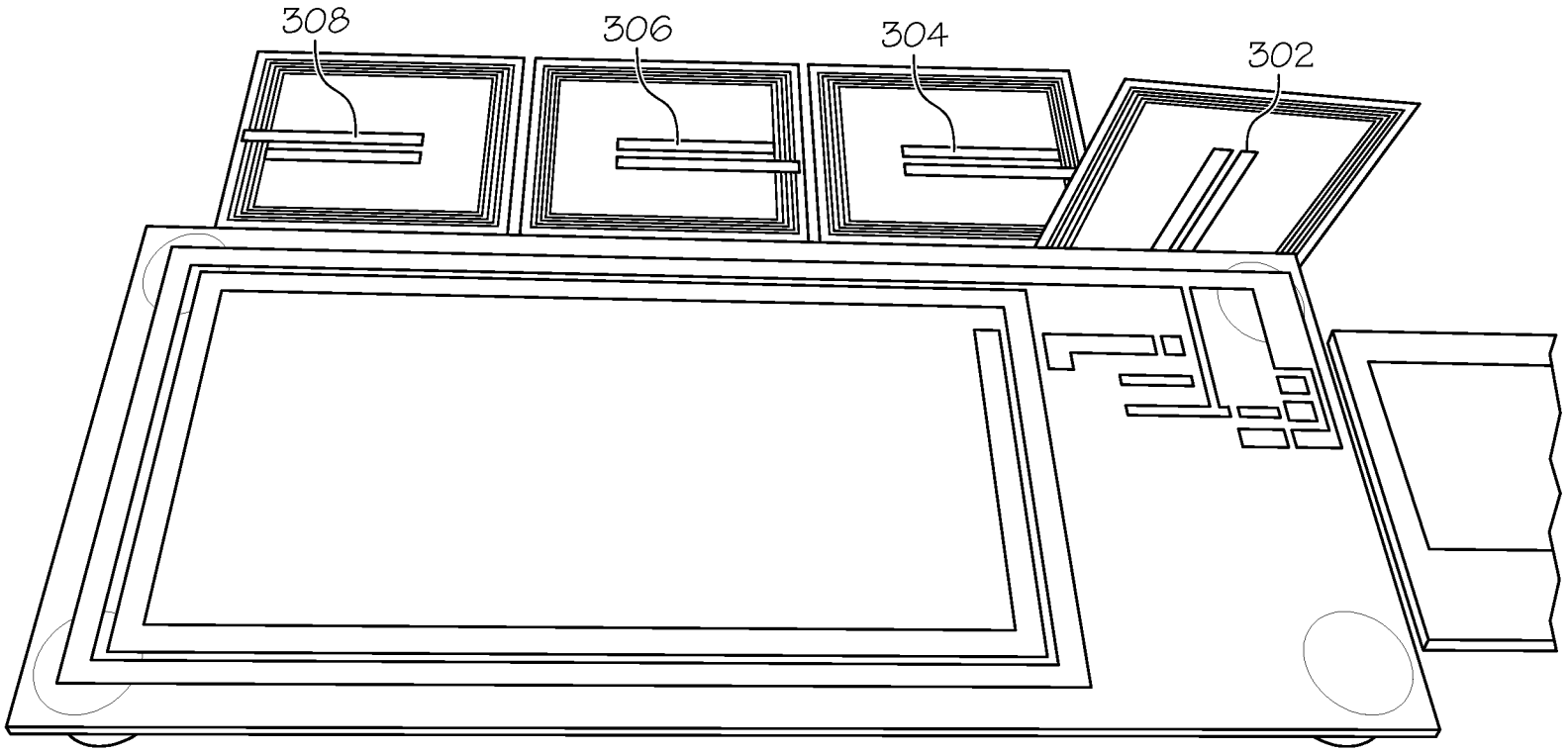
FIG. 3 is front view of the LED connected to the graphic media display of the presently described invention.
Figure 4:
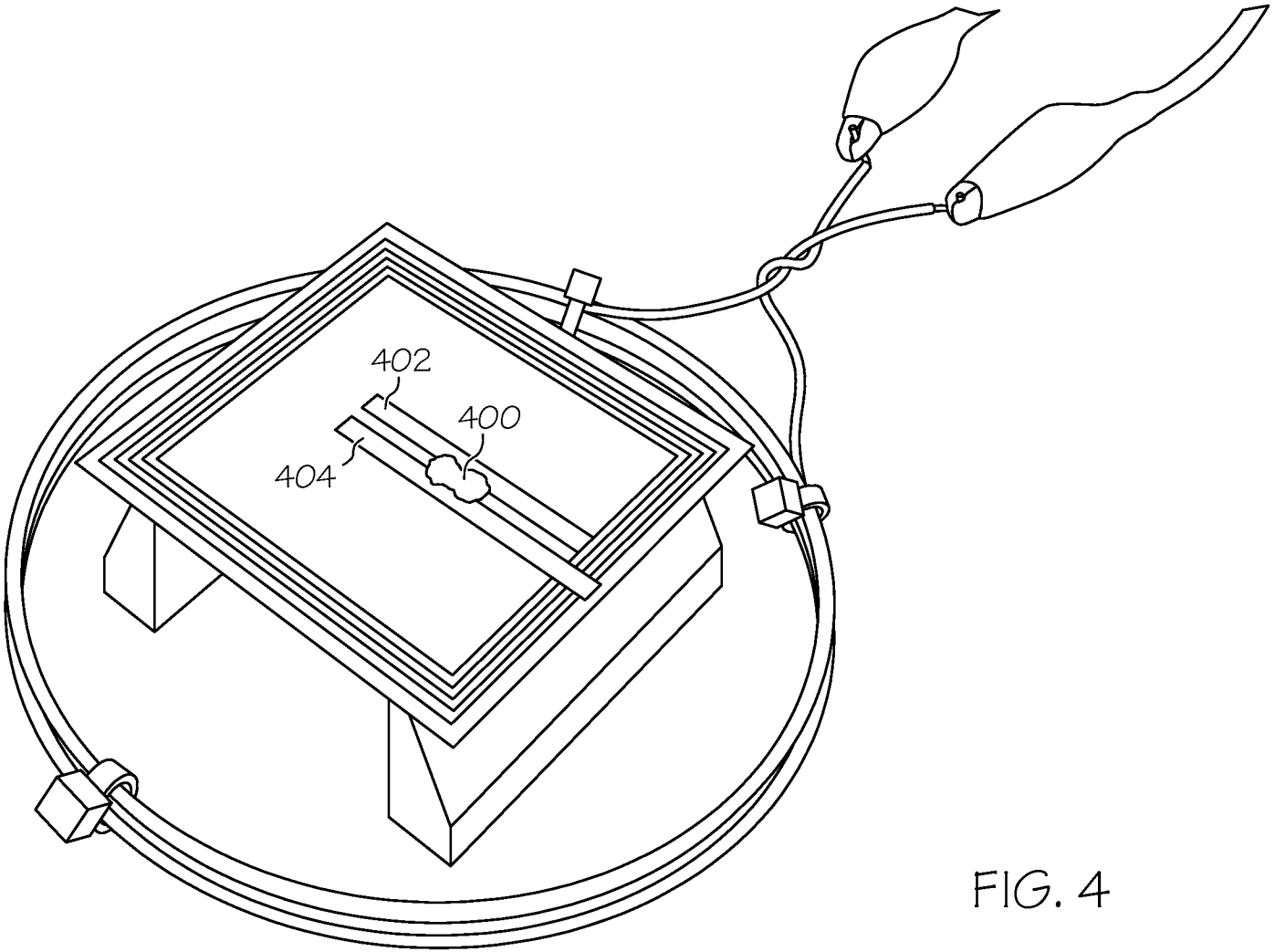
FIG. 4 is a view of one LED for use with the media display.
Figure 6:
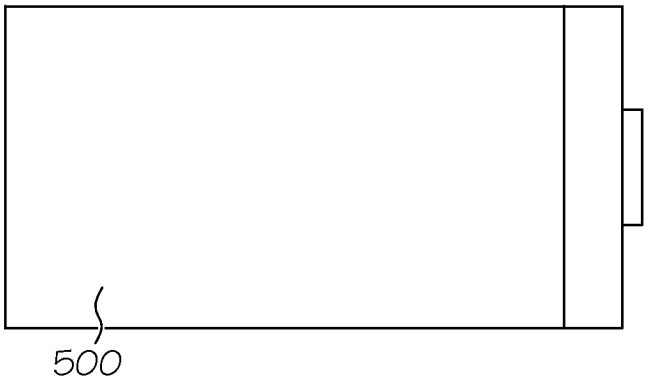
FIGS. 5 and 6 show the media display device adapted for use with printed banners.
Figure 5:
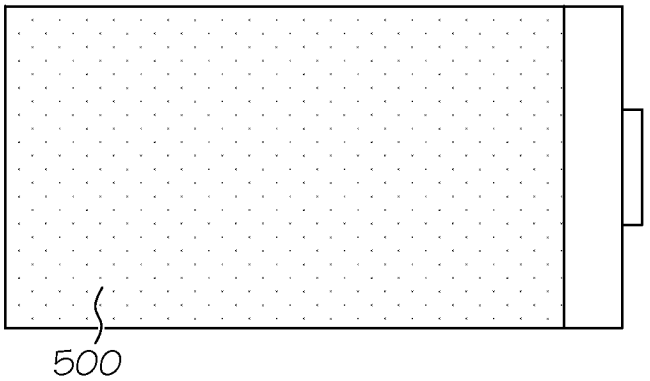

Generally referring to FIGS. 1 and 2, an apparatus for the backlit display of graphic media is disclosed. The apparatus can be constructed to secure graphic media in place and provide varying levels of illumination for viewing. The apparatus can also include electronic communication devices.

FIG. 1 illustrates an exemplary embodiment of display device 100. Display device 100 can contain front panel 102. Front panel 102 can be constructed of any material, for example acrylic. Front panel 102 can be of any thickness, for example 4 millimeters. Front panel 102 can have a transparent portion through which graphic media can be viewed. Front panel 102 can also have a colored or shaded portion, which can surround the transparent portion. The colored or shaded portion can be any color, for example black or white. Front panel 102 can also have a transparent border of any thickness, for example 6 millimeters, which can surround the colored or shaded portion. The side edges of front panel 102 can be diamond-polished.

Still referring to FIG. 1, display device 100 can also contain template panel 104. Template panel 104 can be constructed of any material, for example an aluminum composite material (ACM), acrylic or other material. Template panel 104 can be of any thickness, for example 6 millimeters. Template panel 104 can be bonded to the rear of front panel 102 using adhesive, or using any other known method of attachment. Template panel 104 can contain one or more magnetic fasteners, made for example of rare earth magnets, which can interface with rear panel 110 as described below. Template panel 104 can also contain one or more locking posts, for example locking post 202, which can interface with rear panel 110 as described below. Template panel 104 can contain a viewing aperture, which can correspond in at least one of size, shape, or location with the transparent portion of front panel 102. Template panel 104 can also contain an aperture for electronic communication device 106.

Electronic communication device 106 can be a near-field communication (NFC) device, a radio frequency identification (RFID) device, or any other similar device. In one exemplary embodiment, electronic communication device 106 can communicate with electronic devices such as mobile phones being used by the viewers of display device 100. Electronic communication device 106 can transfer information to the viewers' electronic devices, for instance data, music, or video related to the graphic media being displayed by display device 100. In other exemplary embodiments, electronic communication device 106 can be used for authentication or lighting control purposes, as described below.

Still referring to FIG. 1, display device 100 can also contain graphic media layer 108. Graphic media layer 108 can be made of any material, for example any material that may have an image printed onto or otherwise disposed on the material. Such an image could contain text, graphics, photographic images, or any combinations thereof. The image may be black and white, monotone, or multi-colored. Graphic media layer 108 may be transparent, semi-transparent, or translucent.

Graphic media layer 108 may include an adhesive, which may be disposed on graphic media layer 108 in such a way that it is self-adhering, for example to front panel 102. Graphic media layer 108 may be sized in such a way that it fits through the viewing aperture in template panel 104 in order to adhere to front panel 102. The placement of graphic media layer 108 within the viewing aperture of template layer 104 can facilitate assembly and disassembly of display device 100, by preventing graphic media layer 108 from separating from front panel 102 as it is being attached to and removed from rear panel 110. Graphic media layer 108 may be replaceable by another graphic media layer as desired. In this way, display device 100 can be updated or changed as desired to present various different graphic media to viewers. For example, display device 100 may be used to provide advertising that a user may wish to change from time-to-time. Accordingly, rather than replacing the entire display device 100, the user can merely replace graphic media layer 108.

Graphic media layer 108 can contain an electronic communication device, such as an RFID device, or any other similar device. This RFID device can be integrated into graphic media layer 108, or it may take the form of a label or sticker that is attached to graphic media layer 108. This device can be positioned in such a way that when graphic media layer 108 is installed in template layer 104, the RFID device can communicate with electronic communication device 106.

In one exemplary embodiment, the RFID device associated with graphic media layer 108 can contain authentication data. This authentication data can ensure, for instance, that the graphic media installed is authentic or genuine. As an example, if incorrect authentication data, or no authentication data at all, is presented to electronic communication device 106, it can instruct display device 100 to discontinue operation, for example by turning off illumination. In another exemplary embodiment, the RFID device can contain illumination instructions. After these instructions are received by communication device 106, display device 100 can adjust one or more parameters related to illumination, including color, intensity, and timing in a way that complies with the illumination instructions.

Still referring to FIG. 1, display device 100 can also contain rear panel 110. Rear panel 110 can be constructed of any material, for instance an ACM, acrylic or other material. Rear panel 110 can be of any thickness, for example 6 millimeters.

Rear panel 110 can be attached to a wall or other surface, and can support the rest of display device 100 in the following manner. Front panel 102 can be bonded to template layer 104. Graphic media layer 108 can then be placed into the viewing aperture in template layer 104 and adhered to front panel 102. This entire assembly can then be fastened to rear panel 110 as illustrated in FIG. 2. Rear panel 110 can contain one or more magnetic fasteners, for example rare earth magnets, arranged in such a way that they correspond with the one or more magnetic fasteners on template layer 104 and support the assembly. Rear panel 110 can also contain one or more keyhole slots, for instance keyhole slot 204, arranged in such a way that they correspond with the one or more locking posts on template layer 104. These keyhole slots can provide some support for the assembly and can also be constructed in such a way that removal of the assembly is difficult, helping to prevent tampering or vandalism. Rear panel 110 can also contain a locking device, for instance locking device 206, which can, for example, help to prevent tampering or vandalism. Locking device 206 can include of one or more rods which, when inserted through one or more keyhole slots and locking posts, may prevent removal of the assembly from rear panel 110. Rear panel 110 can also have locking strips affixed on one or more sides to further prevent against tampering or vandalism.

Rear panel 110 can contain an illumination device 112. In one exemplary embodiment, illumination device 112 can be a light-emitting diode (LED) tape-sheet affixed around the outer edge of rear panel 110. Illumination device 112 can also be any other type of lighting source, affixed to rear panel 110 in any other manner. Illumination device 112 can be adjustable in any manner, including color, intensity, and timing, and can be controlled based on the presence or absence of authentication data on graphic media layer 108, lighting instructions contained in graphic media layer 108, or any other desired program. In one exemplary embodiment, display device 100 can contain proximity detectors. Illumination device 112 can be dimmed at certain hours of the day, for instance at night, and brightened momentarily when the proximity detectors indicate that a potential viewer is nearby. In this way certain establishments, for instance hotels, can provide advertising and other graphical displays at all hours without their brightness being overly intrusive.

Generally referring to exemplary FIGS. 3 through 7 and the graphic media display device of the present invention, the display device may also include illuminated labels. The illuminated labels may have discrete LEDs, for example LEDs 302-308 and 402, as shown in exemplary FIGS. 3 and 4, and may be powered wirelessly. Thus, each label may have a pair of LEDs and a coil or an antenna. Additionally, as shown in exemplary FIG. 5 and FIG. 6, the graphic media display device may also be adapted for posters and may use a large area printed organic light-emitting diode (OLED) 500 as the light source, where the OLED 500 is powered in exemplary FIG. 5 and not powered in exemplary FIG. 6. The printed OLED 500 may incorporate a diffuse layer of opaque Polyethylene terephthalate (PET). The graphic media display may use wireless power with a coil or an antenna around the perimeter. A light source may be made roll to roll by a combination of printing and cutting technologies known in the art. The graphic media display device may further be disposable.

Figure 7:
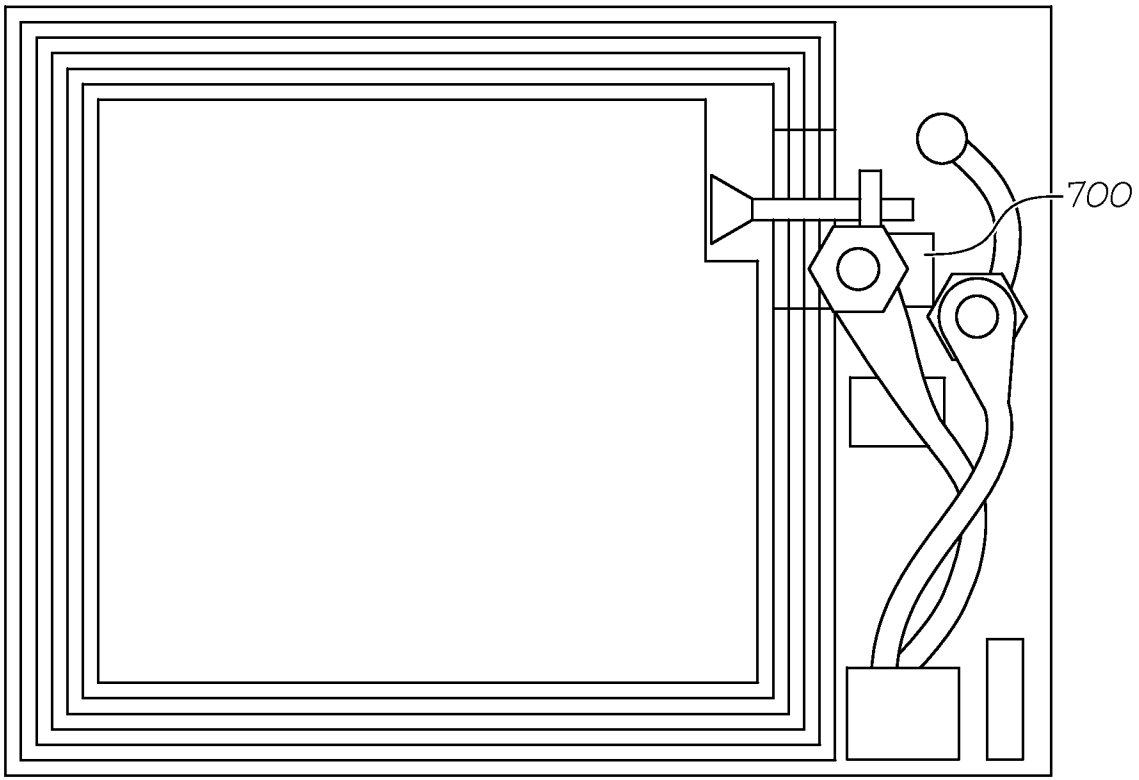
FIG. 7 shows connections used with the LEDs of FIGS. 3 and 4.

In a further embodiment, and referring back to exemplary FIGS. 3 and 4, as well as exemplary FIG. 7, a graphic media display device may include printed circuit board (PCB). The PCB may be a simple transmitter operating, for example, at 8 MHz on 5V. These values may be adjusted up or down as desired. The graphic media display device may have its own power supply. The graphic media display device may also include a plurality of labels, for example, aluminium labels. The plurality of labels may have dual white LEDs in the centre, similar to those described with respect to FIGS. 3 and 4, two leaded parts, e.g. 402 and 404, or any combination thereof. The dual white LEDs may also be self-rectifying and can act as the capacitance to make the coil or an antenna resonant. The leaded parts may be reinforced with epoxy. The labels may be flexible. For example, the labels may be bendable such that they may couple to a bottle or the like. The graphic media display device may also include a copper coil or an antenna, aluminum foil coil or an antenna or the like.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A graphic media display device, comprising:

a display device, the display device having a front panel and a template panel, the front panel having a transparent portion through which a graphic may be view;

the template panel having a viewing aperture and one or more magnetic fasteners, the viewing aperture being sized and configured to correspond with the transparent portion of the front panel;

a rear panel having one or more magnetic fasteners, the magnetic fasteners of the template panel and rear panel are in alignment with one another, the rear panel further including an illumination device;

a graphic media layer having a graphic image surface and a back surface, the graphic image is sized and configured to be viewed through the template panel viewing aperture; and a RFID device associated with the graphic media layer;

wherein the graphic media layer is transparent, semi-transparent, or translucent.

2. A graphic media display device as recited in claim 1, wherein the magnetic fasteners of each of the template panel and rear panel are rare earth magnets.

3. A graphic media display device as recited in claim 1, wherein each of the template panel and rear panel have one or more locking posts.

4. A graphic media display device as recited in claim 3, wherein the one or more locking posts of each of the template panel and rear panel are in alignment with one another.

5. A graphic media display device as recited in claim 1, wherein the template panel further includes an aperture for an electronic communication device.

6. A graphic media display device as recited in claim 5, wherein the electronic communication device is selected from a group including near field communication device, a RFID device or combinations thereof or such similar devices.

7. A graphic media display device as recited in claim 1, wherein the graphic media layer has an adhesive to secure the graphic media layer to the front panel.

8. A graphic media display device as recited in claim 1, wherein the RFID device contains at least one of authentication data and illumination data.

9. A graphic media display device as recited in claim 8, wherein the illumination data includes at least one of color, intensity, timing or combinations thereof.

10. A graphic media display device as recited in claim 1, wherein the rear panel further includes a locking device.

11. A graphic media display device as recited in claim 1, wherein the illumination device in the rear panel is an LED device.

12. A graphic media display device as recited in claim 1, wherein the graphic media display device includes a proximity detector.

13. A graphic media display device as recited in claim 1, wherein the graphic media display device includes a plurality of illuminated labels.

14. A graphic media display device as recited in claim 13, wherein each of the plurality of illuminated labels includes an LED.

15. A graphic media display device as recited in claim 14, wherein each LED is powered wirelessly.

16. A graphic media display device as recited in claim 1, wherein the graphic media display device includes a printed circuit board.

17. A method of using a graphic media display devices, comprising the steps of:

providing a graphic media display device, the graphic media display device having a front panel, template panel and a rear panel, the rear panel having an illumination device;

producing a graphic media layer having a visible graphic on at least one side, the graphic media layer further including a electronic communication device;

inserting the graphic media layer between the template layer and the front panel such that the graphic media layer is adhered to the front panel such that the visible graphic is viewable through an aperture in the front panel; and activating the illumination device to illuminate the graphic media layer, wherein the graphic media layer is transparent, semi-transparent, or translucent.

18. The method as recited in claim 17, wherein the step activating the illumination device includes reading the electronic communication device.

19. The method as recited in claim 17, wherein the electronic communication device includes at least one of illumination data and authentication data.

20. The method as recited in claim 17, including a further step of adding illuminated labels to the graphic media layer.

* * * * *